United States Patent [19]

Lewis

[11] 4,124,791

[45] Nov. 7, 1978

[54] ELECTRICAL SWITCH

[75] Inventor: Keith Lewis, Burnley, England

[73] Assignee: Lucas Industries Limited, Birmingham, England

[21] Appl. No.: 784,859

[22] Filed: Apr. 5, 1977

[30] Foreign Application Priority Data

Apr. 14, 1976 [GB] United Kingdom ..... 15185/76

[51] Int. Cl.[2] ..... H01H 3/12

[52] U.S. Cl. ..... 200/159 R

[58] Field of Search ..... 200/159 R, 153 SC, 153 HS, 200/153 R

[56] References Cited

U.S. PATENT DOCUMENTS

| | | | |
|---|---|---|---|
| 2,144,238 | 1/1939 | Young | 200/159 R |
| 2,314,407 | 3/1943 | Kirsten | 200/159 R |
| 2,386,162 | 10/1945 | Hetherington | 200/159 R |
| 3,300,600 | 1/1967 | Blomquist et al. | 200/159 R |
| 3,404,244 | 10/1968 | Amis et al. | 200/159 R |

*Primary Examiner*—Stephen A. Kreitman

*Attorney, Agent, or Firm*—Holman & Stern

[57] ABSTRACT

An electrical switch wherein electrical contacts are carried within a hollow body and an operating member is slidable in the body to operate the contacts. The operating member is in the form of first and second similarly shaped and interengaged parts the interengagement of the parts, permitting limited movement of the parts relative to one another in the direction of movement of the operating member relative to the body. A spring is trapped between the interengaged parts and urges the parts away from one another in the direction of movement of the operating member whereby during initial movement of the operating member from a rest position the contacts are operated and no relative movement between the first and second parts of the operating member takes place, but during further movement of the operating member relative to the body in the same direction, the first operating member part is moved relative to the second operating member part against the action of the resilient means.

7 Claims, 2 Drawing Figures

ELECTRICAL SWITCH

This invention relates to an electrical switch.

An electrical switch according to the invention includes a hollow body, electrical contacts carried by the body, and an operating member slidable in the body whereby the contacts are operated, said operating member comprising first and second similarly shaped and interengaged parts, the interengagement of said parts permitting limited movement of the parts relative to one another in the direction of movement of the operating member relative to the body, there being resilient means urging the two parts of the operating member apart in the direction of movement of the operating member, and the arrangement being such that during initial movement of the operating member, from a rest position, the first and second parts thereof move in unison and the contacts are operated, while during further movement of the operating member, relative to the body in the same direction, the first operating member part is moved relative to the second operating member part against the action of said resilient means.

Preferably, each of said first and second operating member parts is in the form of a bifurcated strip, the free ends of the two limbs of which include mutually presented barbs, each strip being provided at its end remote from the barbs with an elongate slot, the two strips being interengaged with their planes of right angles to one another, and the barbs of the limbs of one strip engaging in the slot of the other strip and the barbs of the other strip engaging in the slot of said one strip.

Preferably, the outer edge surfaces of said strips are of part cylindrical form, said surfaces of the two strips defining parts of a common imaginary cylinder when the two strips are interengaged, the operating member being received in a bore in the body, the bore being of circular cross-section and having a diameter substantially equal to the diameter of said imaginary cylinder.

Preferably, a resilient diaphragm secured at its periphery to the body, is interposed between said second operating member part and said contacts.

Desirably, said electrical contacts comprise first and second fixed contacts secured to the body and movable bridging contact mounted within the body and movable into and out of engagement with said fixed contacts.

Conveniently, said movable contact is spring urged away from said fixed contacts, and is movable against said spring force by the action of said operating member, said resilient means of said operating member being stronger than the spring acting on the movable contact.

Alternatively said movable contact is spring urged into engagement with said fixed contacts and is movable by the operating member out of engagement with said fixed contacts, said resilient means of said operating member being stronger than the spring acting on the movable contact.

One example of the invention is illustrated in the accompanying drawings, wherein.

Figure 1:
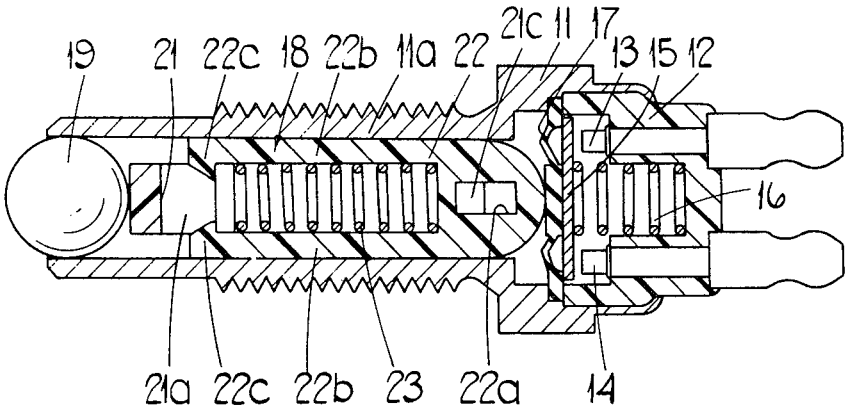
FIG. 1 is a longitudinal sectional view of an electrical switch.
Figure 2:
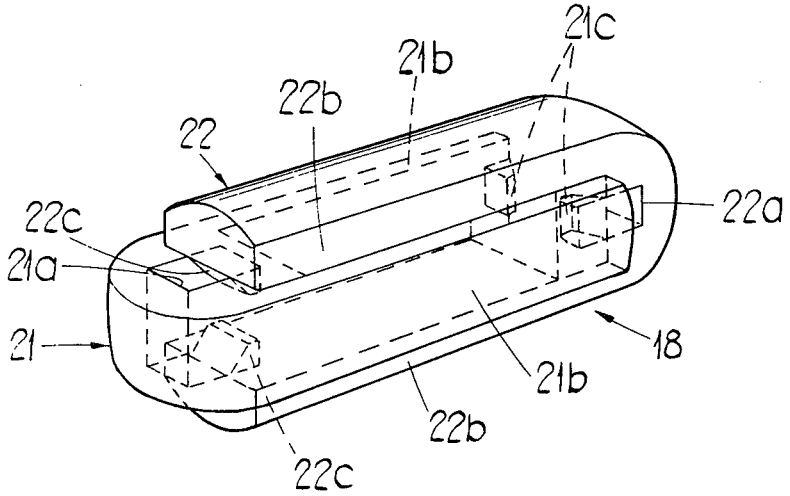
FIG. 2 is a perspective view of the operating member shown in FIG. 1.

Referring to the drawings the electrical switch includes a hollow body comprising a metal cover 11 and a moulded synthetic resin base 12, part of the base being received within the cover 11 and the cover 11 being spun over to retain the base 12 and cover 11 interengaged. The base 12 is recessed, and projecting into the recess are first and second fixed electrical contacts 13, 14 each of which extends through the base 12 and includes an integral terminal pin projecting from the exterior surface of the base 12. Disposed within the recess is a movable bridging contact 15 in the form of a conductive plate capable of simultaneously enaging the fixed contacts 13, 14 to complete an electrical circuit therebetween. A compression spring 16 acts between the base 12 and the moving contact plate 15 to urge the moving contact plate 15 out of engagement with the fixed contacts 13, 14.

Trapped between the base 12 and an annular shoulder on the cover 11 is the periphery of a flexible rubber diaphragm. The periphery of the diaphragm is trapped in sealing engagement with the body and so seals the recess containing the fixed and movablee contacts of the switch. One face of the central region of the diaphragm engages the moving contact plate 15, and the opposite face of the central region of the diaphragm 17 is engaged by one end of the operating member 18 of the switch.

The operating member 18 of the switch is in the form of a two part plunger slidably received in a bore of circular cross-section in a cylindrical extension 11*a* of the cover 11. The end of the plunger remote from the diaphragm 17 is engaged by a steel ball 19 which is held within the bore of the extension 11*a* by a reduction in the diameter of the bore at its end remote from the diaphragm 17. The wall of the extension 11*a* is deformed radially inwardly to reduce the diameter of the bore, and thus prevent the ball being pushed out of the extension 11.

As mentioned above the operating member 18 is in the form of a two part plunger. The two parts 21, 22 of the plunger are identical synthetic resin mouldings, and each is in the form of a relatively thick flat strip, one longitudinal end of which is semi-cylindrical. The part 22 has its semi-cylindrical end abutting the diaphragm 17 while the part 21 has its semi-cylindrical end abutting the ball 19.

Each part 21 22 is formed adjacent its semi-cylindrical end with an elongate, longitudinally extending slot indicated by the suffix *a* in the drawings, and each of the parts is bifurcated so as to define a pair of longitudinally extending limbs indicated by the suffix *b*. The spacing between the inner surfaces of the limbs of the parts 21, 22 is equal to the thickness of the parts 21, 22 and at their free ends each of the limbs of the parts is provided with an inwardly directed barb indicated by the suffix *c*.

In addition to having their semi-cylindrical ends at opposite ends respectively of the operating member which they define, the two parts 21, 22 are disposed longitudinally aligned with their planes at right angles to one another. The two parts 21, 22 are inter-engaged such that their limbs extend adjacent one another, with the barbs 22*c* of the parts 22 engaged in the slot 21*a* of the part 21, while simultaneously the barbs 21*c* of the parts 21 are engaged in the slots 22*a* of the part 22. A compression spring 23 extends longitudinally of the two parts 21, 22 and occupies the volume bounded by the four limbs. The opposite ends of the compression spring 23 act against the members 21, 22 respectively and thus urge the members longitudinally apart. The action of the spring 23 therefore is to maximize the length of the two part plunger constituting the operating member of the switch, the action of the spring 23 being limited by engagement of the barbs 22*c* with one end of the slot 21*a* and simultaneous engagement of the barbs 21c with one end of the slot 22a. The side edges of the parts 21, 22 defined by the thickness of each of the parts are part cylindrical, and are such that when the two parts are interengaged to define the plunger then the four part cylindrical surfaces define parts of the surface of a common imaginary cylinder the diameter of which is substantially equal to, but not greater than, the diameter of the bore in the extension 11a of the cover 11. The two parts 21, 22 and the spring 23 are assembled before engagement in the bore, of the cover 11 the barbs 21c, 22c being chamfered on their leading faces to facilitate snap interengagement of the two parts.

After engagement of the two part plunger in the bore, the two parts 21, 22 can move longitudinally relative to one another as permitted by compression of the spring, by an amount determined by the length of the slots 21a, 22a and the dimensions of the barbs. However, normally the spring 23 holds the plunger at its maximum length.

The spring 23, is stronger than the spring 16 and thus when the ball 19 is depressed into the bore of the extension 11a the movement is transmitted by the two part plunger and the flexible diaphragm 17 to the movable contact 15 to move the contact 15 against the action of the spring 16 to a position wherein it bridges the fixed contacts 13, 14. Thereafter of course, further movement of the contact 15 and diaphragm 17 is prevented by the fixed contacts 13, 14. Should the ball 19 be depressed further into the extension 11a then the part 21 of the two part plunger defining the operating member 18 will be moved relative to the parts 22 as permitted by compression of the spring 23. The extent of the permitted longitudinal compression of the operating member is sufficient to accommodate the maximum movement of the ball 19 which will occur in use.

Upon release of the ball 19 the spring 23 re-establishes the maximum length of the operating member, and the spring 16 restores the contact 15 to its rest position spaced from the fixed contacts 13, 14. It will be understood that the rest position is determined ultimately by the engagement of the ball 19 with the reduced diameter portion of the bore extension 11a of the cover 11.

The resiliently compressible operating member 18 of the switch permits a movement of the ball 19 in excess of the required movement of the movable contact 15, and it will be understood that without the provision of the longitudinally compressible operating member then the overtravel of the ball 19 would subject the diaphragm 17 and movable contact 15 to excessive loadings which could cause damage to the diaphragm and the movable contact 15. In addition of course such axial loadings would be transmitted to the fixed contacts and to the coupling between the base 12 and the cover 11 and to the connection between the cover 11 and the supporting structure. All of these elements would be susceptible to damage as a result of the overtravel. The exterior of the extension 11a of the cover 11 is screw threaded to facilitate mounting of the switch in use. It will be appreciated that the construction of the longitudinally compressible plunger of the switch from two identical moulded parts with a simple snap-interengagement, is extremely convenient and beneficial from the point of view of manufacturing and assembly costs.

In a modification the switch is normally closed, the movable contact being spring urged into engagement with the fixed contacts and being movable out of engagement therewith by the movement of the operating member relative to the body. Movement of the movable contact away from the fixed contacts is limited by abutment with the base of the switch whereafter the two operating member parts are moved relative to one another as described above.

I claim:

1. "An electrical switch including a hollow body, electrical contacts carried by the body, and an operating member slidable in the body whereby the contacts are operated, said operating member comprising first and second identical parts, said first and second parts being inter-engaged, the first part having components which engage as a snap-fit with the second part, and the second part similarly having components which engage the first part as a snap-fit, the inter-engagement of the first and second parts permitting limited relative movement of the parts in the direction of movement of the operating member relative to the body, and, resilient means urging the first and second parts apart in the direction of movement of the operating member, whereby during initial movement of the operating member from a rest position the first and second part of the operating member move in unison, and the contacts of the switch are operated, while during further movement of the operating member relative to the body of the switch after operation of the contacts the first operating member part is moved relative to the second operating member part against the action of said resilient means."

2. A switch as claimed in claim 1 wherein said first and second operating member parts is in the form of a bifurcated strip, the free ends of the two limbs of which include mutually presented barbs, each strip being provided at its end remote from the barbs with an elongate slot, the two strips being interengaged with their planes of right angles to one another, and the barbs of the limbs of one strip engaging in the slot of the other strip and the barbs of the other strip engaging in the slot of said one strip.

3. A switch as claimed in claim 2 wherein the outer edge surfaces of said strips are of part cylindrical form, said surfaces of the two strips defining parts of a common imaginary cylinder when the two strips are interengaged, the operating member being received in a bore in the body, the bore being of circular cross-section and having a diameter substantially equal to the diameter of said imaginary cylinder.

4. A switch as claimed in claim 1 wherein a resilient diaphragm secured at its periphery to the body, is interposed between said second operating member part and said contacts.

5. A switch as claimed in claim 1 wherein said electrical contacts comprise first and second fixed contacts secured to the body and a movable bridging contact mounted within the body and movable into and out of engagement with said fixed contacts.

6. A switch as claimed in claim 5 wherein said movable contact is spring urged away from said fixed contacts, and is movable against said spring force by the action of said operating member, said resilient means of said operating member being stronger than the spring acting on the movable contact.

7. A switch as claimed in claim 5 wherein said movable contact is spring urged into engagement with said fixed contacts and is movable by the operating member out of engagement with said fixed contacts, said resilient means of said operating member being stronger than the spring acting on the movable contact.

* * * * *